US006305581B1

(12) United States Patent
Bonningue et al.

(10) Patent No.: US 6,305,581 B1
(45) Date of Patent: Oct. 23, 2001

(54) DIAPHRAGM PUMP AND A RECEPTACLE FITTED THEREWITH

(75) Inventors: Philippe Bonningue, Paris; Alain Behar, Suresnes, both of (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/612,942

(22) Filed: Jul. 10, 2000

(30) Foreign Application Priority Data

Jul. 19, 1999 (FR) ..... 99 09331

(51) Int. Cl.[7] ..... B65D 88/54

(52) U.S. Cl. ..... 222/321.3; 222/207; 222/321.1; 222/321.2; 222/321.7

(58) Field of Search ..... 222/321.1, 321.2, 222/207, 321.3, 321.8, 321.7, 321.9

(56) References Cited

U.S. PATENT DOCUMENTS 5,687,884 * 11/1997 Bodin et al. ..... 222/321.7
5,704,519 * 1/1998 Crosnier et al. ..... 222/207
5,788,124 * 8/1998 Bougamont et al. ..... 222/207

FOREIGN PATENT DOCUMENTS 2 728 809 A1 7/1996 (FR) .

* cited by examiner

*Primary Examiner*—Kevin Shaver
*Assistant Examiner*—Melvin A. Cartagena
(74) *Attorney, Agent, or Firm*—Oliff & Berridge, PLC

(57) ABSTRACT

A pump of type comprising a moving member mounted to move relative to a support, the moving member having a central duct into which the substance to be dispensed penetrates via at least one opening, the support co-operating with the moving member to define a variable volume pump chamber around said central duct, the pump also having a diaphragm having a central portion in which said central duct is inserted, the diaphragm being organized in such a manner as to isolate the pump chamber from the opening(s) of the central duct when the volume of the pump chamber increases and the substance is sucked into it. At least one of the central duct and the central portion of the diaphragm includes an annular bulge that is suitable, when the volume of the pump chamber increases, for bearing in leakproof manner on the other of the central portion and the central duct of the diaphragm, so as to isolate the pump chamber from the opening(s) of the central duct.

38 Claims, 7 Drawing Sheets

DIAPHRAGM PUMP AND A RECEPTACLE FITTED THEREWITH

The present invention relates to a pump and to a receptacle containing a liquid, for example a cosmetic cream, and fitted with such a pump.

BACKGROUND OF THE INVENTION

French patent 2 728 809 discloses a pump comprising a pushbutton displaceably mounted on a support which is secured to the receptacle containing the substance to be dispensed, the pushbutton having a circularly cylindrical central duct provided with radial openings at its bottom end, the support defining an annular pump chamber of variable volume around said duct. A diaphragm made of elastomer is mounted on the support. The diaphragm has a circularly symmetrical central portion in the form of a sleeve that is open at its top end and closed at its bottom end. The central duct of the pushbutton is inserted in the diaphragm until it bears against the end wall of the sleeve. The diaphragm constitutes a resilient return member enabling the pushbutton to be returned to its initial position after a quantity of substance has been dispensed.

During the return movement of the pushbutton, the diaphragm presses against the central duct and isolates the pump chamber from the radial openings of the central duct so at to prevent air returning into the pump chamber.

Such a pump presents the advantage of having only a small number of parts and thus of being of relatively low cost to manufacture.

Nevertheless, that known pump does not provide complete satisfaction, and the Applicant company has observed, in particular, difficulties in priming.

OBJECTS AND SUMMARY OF THE INVENTION

The present invention seeks to improve the reliability of the operation of a pump of the above-defined type, i.e. comprising a moving member mounted to move relative to a support, the moving member having a central duct into which the substance to be dispensed penetrates via at least one opening, the support co-operating with the moving member to define a variable volume pump chamber around said central duct, the pump also having a diaphragm having a central portion in which said central duct is inserted, the diaphragm being organized in such a manner as to isolate the pump chamber from the opening(s) of the central duct when the volume of the pump chamber increases and the substance is sucked into it.

The invention achieves this by at least one of the central duct and the central portion of the diaphragm including an annular bulge that is suitable, when the volume of the pump chamber increases, for bearing in leakproof manner on the other of the central portion and the central duct of the diaphragm, so as to isolate the pump chamber from the opening(s) of the central duct.

In other words, the above-mentioned bulge ensures that the annular passage formed around the central duct between the pump chamber and the opening(s) of the central duct is closed during the suction stage.

The surface of the diaphragm which bears on the central duct to ensure said closure is slightly stretched as a result of the presence of the bulge, such that low air pressure in the pump chamber can suffice to break the sealing between the diaphragm and the central duct.

This makes the pump easier to prime.

In addition, it is generally desirable to use a relatively hard elastomer to make the diaphragm, enabling a relatively high return force to be obtained without having to prestress the diaphragm to excess, the drawback of prestressing the diaphragm too much being the risk of rupturing the diaphragm in the long term.

However, the use of a harder elastomer tends to increase priming difficulties since the diaphragm deforms less easily.

The invention enables the influence of the modulus of elasticity of the material constituting the diaphragm on the operation of the pump to be reduced to some extent, and thus enables a harder elastomer to be used so as to reduce the prestress of the diaphragm while maintaining the desired spring effect.

To make manufacture easy by molding plastics material, the bulge is preferably formed on the inner surface of the central portion of the diaphragm.

The bulge thus formed on the central portion of the diaphragm bears in sealed manner on the central duct so as to isolate the pump chamber from the opening(s) of the central duct, at least while the volume of the pump chamber is increasing.

Advantageously, when at rest, the bulge also bears in sealed manner on the central duct.

In a variant, the bulge is formed on the outer surface of the central duct.

When the bulge is formed on the inner surface of the diaphragm, one or more hollow or projecting portions in relief are advantageously formed on the central duct, remote from the bulge when the moving member is in the high position, and reaching the bulge at the end of the down stroke of the moving member, the portions in relief being organized in such as manner as to facilitate the creation, at that moment, of a passage between the pump chamber and the opening(s) of the central duct.

The portion(s) in relief is/are in the form of one or more ribs formed on the outer surface of the central duct, for example.

In a particular embodiment, the central portion of the diaphragm includes a base comprising an inner stud that is organized so as to engage in the bottom end of the central duct.

Such a stud enables the bottom end of the central portion of the diaphragm to be held relatively stable on the bottom end of the central duct.

In a particular embodiment, the diaphragm has a flexible lip suitable firstly for isolating the pump chamber from the source of substance when the volume of said pump chamber decreases, and secondly for enabling substance to enter into said pump chamber when the volume thereof increases.

In a particular embodiment, said flexible lip is connected to the central portion of the diaphragm by forming a downwardly open annular trough, and the support includes an inner skirt having its top end bearing against the end wall of said trough to retain the diaphragm when the moving member is moved downwards to decrease the volume of the pump chamber.

Preferably, said inner skirt has openings at its top end, the openings being of a height that is less than the height of the flexible lip, said openings enabling the substance to reach the pump chamber when the volume thereof increases and the flexible lip moves away from the inner skirt.

In a particular embodiment, the central portion of the diaphragm is connected at its top end to an annular portion whose width and thickness are selected in such a manner as to improve retention of the diaphragm when said central portion is stretched.

Preferably, the thickness of the above-mentioned annular portion, prior to the diaphragm being assembled in the pump, is greater than or equal to the thickness of the diaphragm in its central portion.

Preferably, the above-mentioned annular portion, prior to the diaphragm being assembled in the pump, is at least 1.5 times wider than it is thick, and preferably twice as wide as it is thick.

One of the flexible lip and the inner skirt preferably includes an annular bulge that is suitable for bearing on the other of the inner skirt and the flexible lip so as to isolate the pump chamber from the inside of the receptacle when the volume of the pump chamber decreases.

In a particular embodiment, the flexible lip includes an annular bulge on its inner surface that is suitable for bearing in sealed manner on the inner skirt so as to isolate the pump chamber from the source of substance at least when the volume of the pump chamber decreases.

At rest, the annular bulge advantageously bears in sealed manner on the inner skirt.

The flexible lip advantageously includes, above said annular bulge, a preferred deformation zone that is preferably constituted by a thin zone.

In a variant, the inner skirt includes on its outer surface an annular bulge that is suitable for bearing in leakproof manner on the flexible lip so as to isolate the pump chamber from the source of substance when the volume of the pump chamber decreases.

In a particular embodiment, the height of the above-mentioned flexible lip is greater than or equal to the height of the central portion of the diaphragm, prior to the diaphragm being assembled in the pump.

In a particular embodiment, the outer surface of the flexible lip presents, in the vicinity of its top end, a portion that is conical and diverges towards the top end of the diaphragm, which portion is connected via a shoulder to an annular rib.

Preferably, the inside diameter of the flexible lip is equal to the outside diameter of the inner skirt, ignoring manufacturing tolerances.

Also preferably, the clearance between the flexible lip and the inner skirt is negative or zero; this ensures that the flexible lip is lightly clamped against the inner skirt.

In a particular embodiment, when the moving member is at rest, the length of the central portion of the diaphragm after being assembled in the pump is greater than or equal to 1.5 times its initial length prior to assembly in the pump, or greater than or equal to twice said initial length, or even greater than or equal than 3 times said initial length.

In a particular embodiment, when the moving member is fully depressed, the length of the central portion of the diaphragm is greater than or equal to twice the initial length of the diaphragm prior to assembly in the pump, or greater than or equal to 3 times said initial length, or even greater than or equal to 4 times said initial length.

In a particular embodiment, at least one of the diaphragm and the central duct is shaped to prevent an annular zone forming between the diaphragm and the central duct that would prevent the substance contained in the pump chamber from flowing via said central duct when the volume of the pump chamber decreases.

Preferably, at least one of the diaphragm and the central duct is shaped so as to bear against the other of the central duct and the diaphragm at predetermined locations of its periphery, at least during displacement of the moving member relative to the support.

Preferably, at least one of the diaphragm and the central duct has portions in relief against which the other of the central duct and the diaphragm comes to bear, at least during displacement of the moving member relative to the support.

This guarantees that the pump operates reliably without any risk of the moving member jamming while the volume of the pump chamber is varying.

The above-mentioned portions in relief tend to prevent the diaphragm from blocking the flow of substance coming from the pump chamber and going towards the opening(s) of the central duct via which the substance penetrates prior to being dispensed while the volume of the pump chamber is decreasing.

These portions in relief also tend to keep the central duct of the moving member on the axis of the central portion of the diaphragm, which is favorable to satisfactory operation of the pump.

In a preferred embodiment, said portions in relief are made on the diaphragm, preferably being constituted by bulges uniformly distributed around the axis of the central portion of the diaphragm at its opening, said bulges preferably extending over the top face of the diaphragm.

In a particular embodiment, the support has a pair of sealing lips bearing in leakproof manner on a tubular skirt of the moving member, said tubular skirt being downwardly open and extending around the central duct concentrically thereabout, said tubular skirt also defining the pump radially outer wall of the pump chamber.

In a particular embodiment, the inner skirt is a portion of a piece fitted to the remainder of the support.

In a preferred embodiment, the central duct of the moving member is provided with at least one radial opening at its bottom end.

In a preferred embodiment, the moving member constitutes a pushbutton, the central duct being integrally formed with a dispenser endpiece.

In a particular embodiment, the tubular skirt of the moving member slides inside a guide skirt of the support, co-operating with the inner skirt of the support to define an upwardly open annular trough which communicates with the source of substance via at least one air intake orifice, the tubular skirt of the moving member bearing in leakproof manner against said guide skirt when the moving member is at rest and the volume of the pump chamber is at a maximum.

The diaphragm can be made of a nitrile elastomer or of a silicone elastomer, for example, and other materials can naturally be used.

The invention also provides a receptacle fitted with a pump as defined above.

BRIEF DESCRIPTION OF THE DRAWINGS

Other characteristics and advantages of the present invention will appear on reading the following detailed description of a non-limiting embodiment of the invention and of variant implementations, and on examining the accompanying drawings, in which.

MORE DETAILED DESCRIPTION

Figure 1:
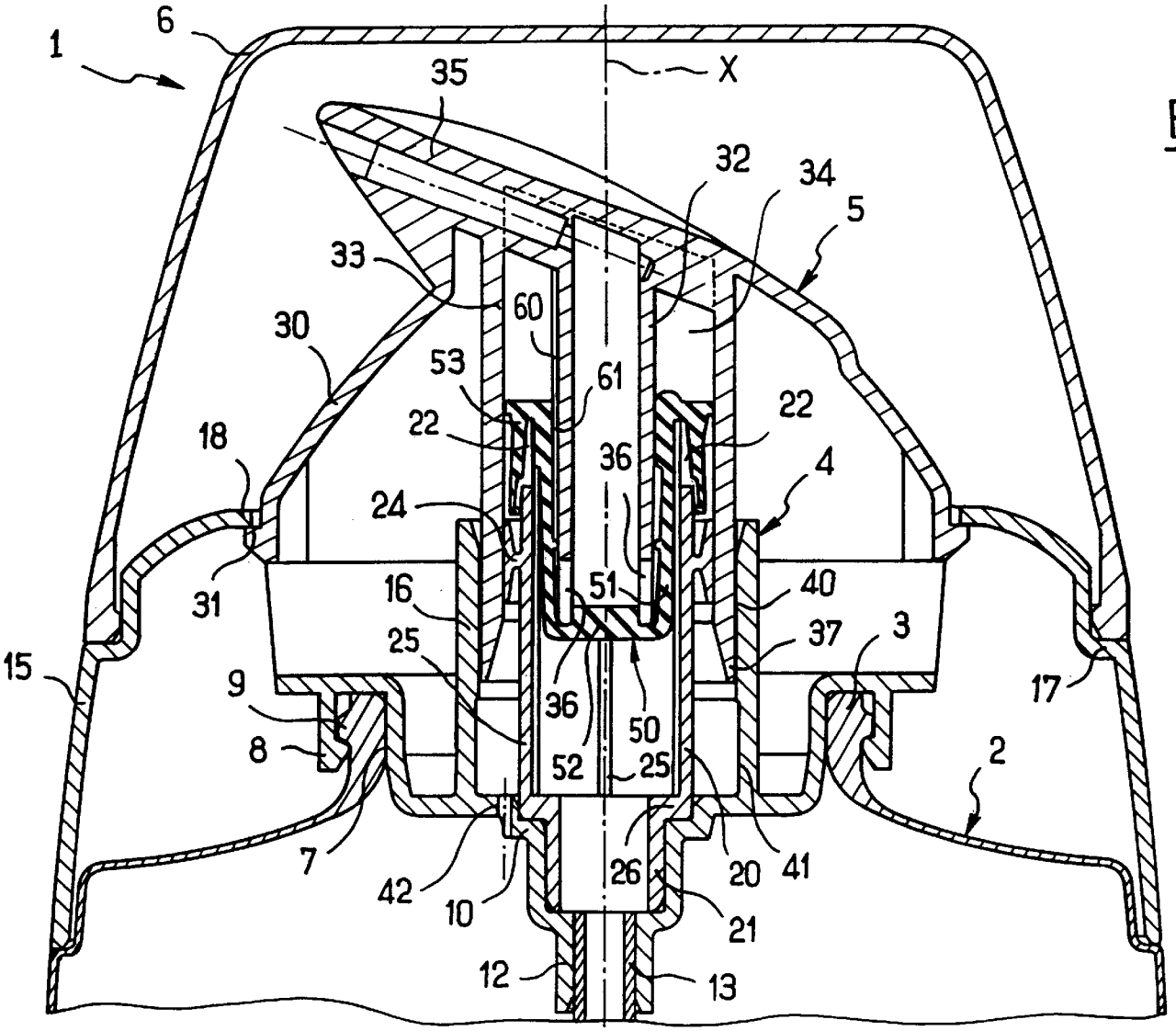
FIG. 1 is a diagrammatic view of the top portion of a receptacle fitted with a pump of the invention.

FIG. 1 shows a receptacle 1 comprising a tank-forming body 2 of which only the top end is shown in the drawing, defining a neck 3 on which a support 4 is snap-fastened.

The support 4 guides a pushbutton 5 in sliding along an axis X, and it serves to mount a removable protective cap 6 covering the pushbutton 5 prior to first use.

The support 4 has a sealing skirt 7 bearing in leakproof manner against the inner surface of the neck 3.

The sealing skirt 7 is extended radially, firstly outwards by fixing tabs 8 snap-fastened on an annular rim 9 of the neck 3, and secondly inwards in the form of a stepped wall 10 defining an endpiece 12 for connecting a dip tube 13, shown in part in the drawing.

An outer skirt 15 and a guide skirt 16 are integrally formed together with the sealing skirt 7, the fixing tabs 8, and the stepped wall 10 by molding a plastics material.

The outer skirt 15 extends around the neck 3 of the receptacle and presents a shoulder 17 on which the protective cap 6 bears.

The top edge 18 of the outer skirt 15 holds the pushbutton 5 at rest, as explained below.

The support 4 has an inner skirt 20 constituted by a separate part, with a bottom end 21 having a shoulder that is engaged by force into the stepped wall 10.

Figure 2:
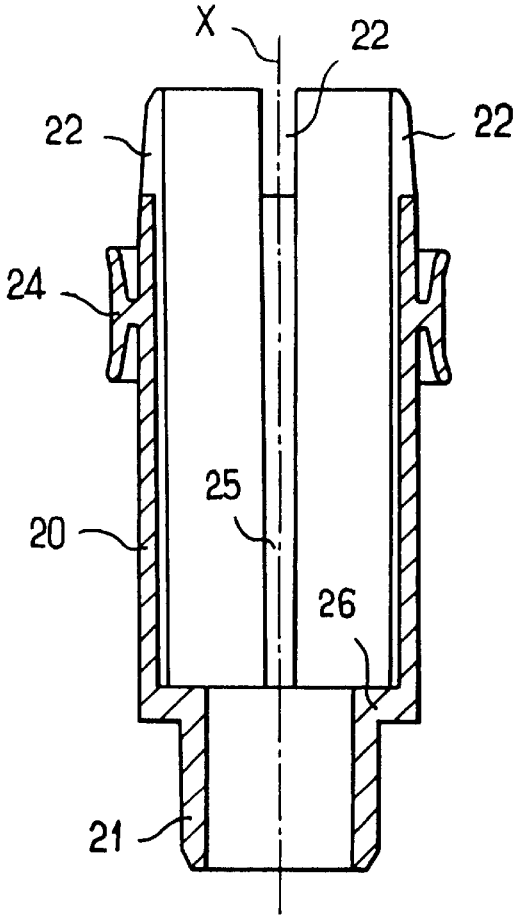
FIGS. 2 and 3 show the inner skirt of the support in isolation.
Figure 3:
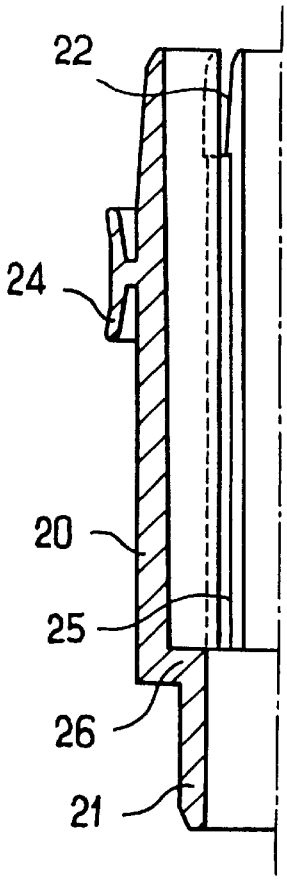

The inner skirt 20 has a substantially tapering top end provided with openings 22, as can be seen more particularly in FIGS. 2 and 3.

In the example described, these openings 22 are in the form of slots running parallel to the axis X and extended downwards by grooves 25 occupying the radially inner surface of the inner skirt 20 as far as a step 26.

A pair of annular sealing lips 24 are integrally formed with the inner skirt 20 on the outside of said skirt by molding a plastics material.

The pushbutton 5 has an outer skirt 30 provided at its bottom end with teeth 31, which teeth come into abutment against the top edge 18 of the outer skirt 15 of the support 4 when the pushbutton 5 is at rest in its high position, as shown in FIG. 1.

The pushbutton 5 has a central duct 32 on the axis X, and a concentric tubular skirt 33 defining an annular pump chamber 34 around the central duct 32.

The outer skirt 30, the tubular skirt 33, and the central duct 32 are formed integrally with a dispenser endpiece 35 communicating internally with the central duct 32 by molding a plastics material.

At its bottom end, the central duct 32 has radial openings 36.

Figure 4:
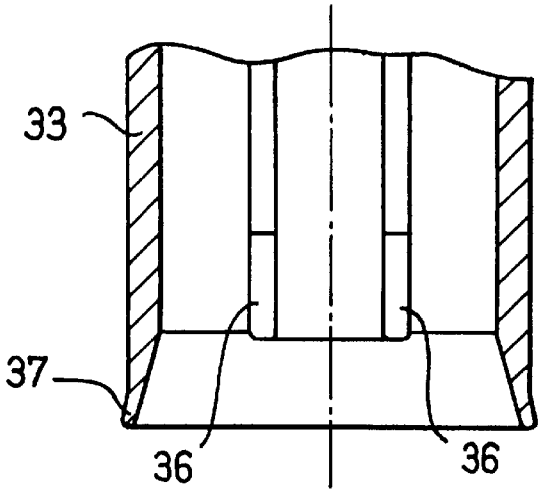
FIG. 4 shows a fragment of the bottom end of the tubular skirt of the moving member in isolation.

The bottom end of the tubular skirt 33 forms a sealing lip 37 extending radially outwards to a small extent, as is shown more particularly in FIG. 4.

The bottom portion of the guide skirt 16 of the support 4 has a shallow annular setback 41 in its radially inner surface.

When the pushbutton 5 is in the high position, the sealing lip 37 presses in leakproof manner against the circularly cylindrical surface 40 of the top portion of the guide skirt 16, as shown in FIG. 1.

The inside of the receptacle is thus isolated from ambient air, which is favorable to good conservation of the substance to be dispensed.

When the pushbutton 5 is pressed down, the sealing lip 37 ceases to bear in leakproof manner against the guide skirt 16 because of the annular setback 41, thereby enabling the trough formed between the inner skirt 20 and the guide skirt 16 to communicate with the outside.

An air intake orifice 42 is formed in the bottom of this trough to allow air to penetrate into the receptacle progressively as it empties.

The inner skirt 20 serves as a mount for a diaphragm 50 having a sleeve-shaped central portion 51 about the axis X which is open at its top end and closed at its bottom end by an end wall 52.

Figure 5:
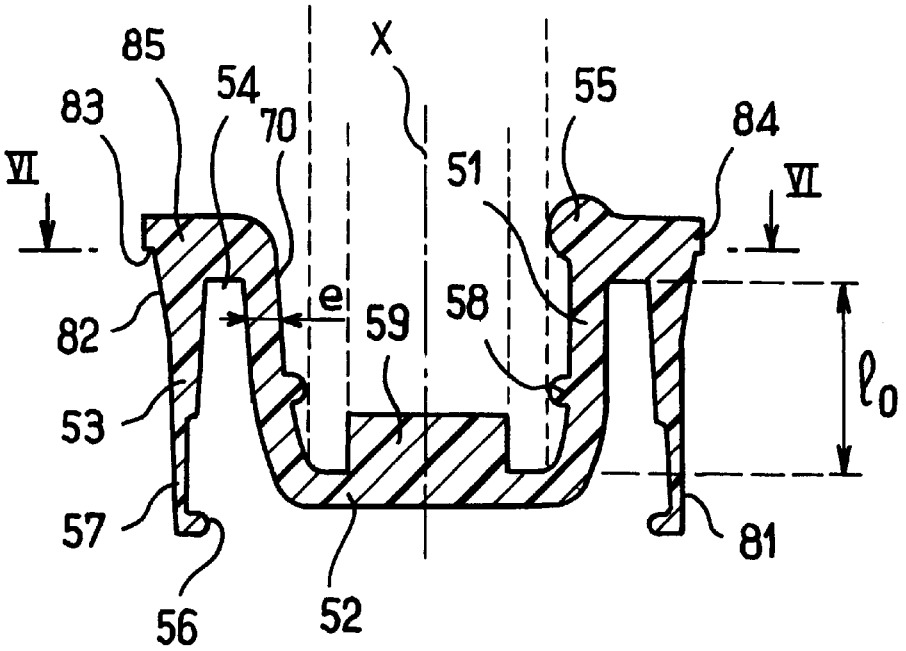
FIG. 5 is a diagrammatic axial section showing in isolation the diaphragm for fitting to the pump 1, prior to being assembled in the pump.

This central portion 51 is extended radially outwards by a flexible annular lip 53, as can be seen more particularly in FIG. 5.

By connecting with the central portion 51, this flexible lip 53 forms an annular trough 54 in which the top end of the inner skirt 20 is inserted until its free edge bears against the end wall of said trough.

The flexible lip 53 is made in such a manner as to clamp lightly on the inner skirt 20.

The height of the flexible lip 53 is greater than the height of the openings 22, and the flexible lip 53 is suitable at rest for bearing in leakproof manner against the outer surface of the inner skirt 20 beyond the openings 22, as shown in FIG. 1.

More particularly, in the embodiment described and as can be seen in FIG. 5, the flexible lip 53 includes, at its bottom end and on its radial inner surface, an annular bulge 56 of semi-circular section that is suitable at rest for bearing via its summit line on the inner skirt 20.

The flexible lip 53 has a thinner zone 57 above the bulge 56 so as to enable the bottom portion of the flexible lip 53 to deform outwards so as to enable the bulge 56 to move away easily from the inner skirt 20 when the substance contained in the receptacle is to enter the pump chamber.

Starting from its bottom end, the outside surface of the flexible lip 53 has a bottom portion 81 that is substantially circularly cylindrical about the axis X, followed by an upwardly divergent conical upper portion 82, said upper portion 82 being connected via a shoulder 83 to an annular rib 84.

At the opening of its central portion 51, the diaphragm 50 has portions in relief that are not circularly symmetrical about the axis X, i.e. in this particular example bulges 55 whose function is explained below.

Figure 6:
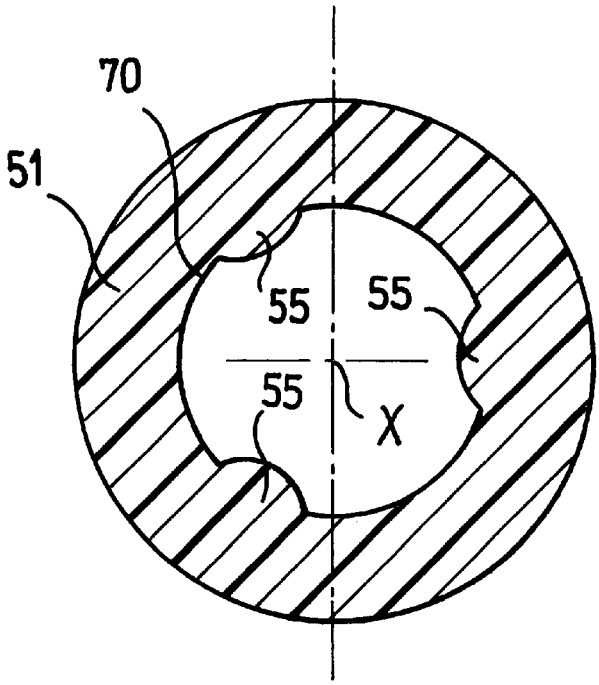
FIG. 6 is a section on section line V1—V1 of FIG. 5.

In the embodiment described, there are three of these bulges 55 and they are uniformly distributed angularly about the axis X, as can be seen in FIG. 6.

Each of these bulges 55 projects from the radially inner surface of the central portion 51, and each extends radially outwards over the top face of the diaphragm 50 so as substantially to overlie the trough 54.

Each of the bulges 55, when observed in section in a cross-section plane, also presents a section that is convex towards the axis X, as shown in FIG. 6.

The inner surface of the central portion 51 of the diaphragm has a top portion 70 that is slightly conical towards the end wall 52.

The bulges 55 extend over this conical portion 70.

The annular portion 85 which unites the flexible lip 53 to the central portion 51 is relatively wide and thick, thus making it possible to ensure that the top end of the central portion 51 is indeed held stationary relative to the inner skirt 20 when the central portion 51 is stretched.

In the embodiment described, the annular portion 85 is about twice as wide as it is thick, outside the bulges 55.

On its inner surface, the central portion 51 of the diaphragm includes an annular bulge 58 of semi-circular section.

The bulge 58 is designed to bear via a generator line on the outer surface of the central duct 32, above the openings 36, when the pushbutton rises, so as to close the passage between the pump chamber 34 and the inside of the central duct 32.

In the example described, the bulge 58 has a radius of 0.25 mm, the thickness e of the wall constituting the central portion 51 of the diaphragm being 0.55 mm.

The bottom 52 of the central portion 51 of the diaphragm includes a stud 59 on its top face that is designed to engage in the bottom end of the central duct 32.

The central duct 32 is shown in dashed lines in FIG. 5.

The outside diameter of the stud 59 corresponds to the inside diameter of the central duct 32.

The stud 59 enables the bottom 52 of the diaphragm to be held stationary relative to the central duct 32.

When the pushbutton 5 is at rest, as shown in FIG. 1, the length of the central portion 51 of the diaphragm is about 3 times the initial length $l_0$ of the central portion 51, i.e. lengthening reaches 200%.

By way of example, when the diaphragm 50 is not assembled, the length $l_0$ measured between the end wall of the trough 54 and the top face of the end wall 53 is about 3 mm, and when the diaphragm is in place in the pump and the pushbutton is at rest, as shown in FIG. 1, the length of the central portion 51 is about 9 mm.

In the example described, at the end of the down stroke of the pushbutton 5, the central portion 51 is lengthened by 350%.

In the example under consideration, the length of the central portion 51 is then about 13.5 mm, the down stroke of the pushbutton 5 being 4.5 mm.

During assembly, the central duct 32 of the pushbutton 5 is inserted into the central portion 51 of the diaphragm 50 until its bottom end bears against the end wall 52 of the diaphragm 50 around the stud 59, as shown in FIG. 1.

The bulges 55 then bear against the circularly cylindrical surface of the central duct 32. Nevertheless, in general, it is not essential for the bulges 55 to bear against the central duct 32 when the pushbutton is at rest.

While the pushbutton 5 is at rest, the central portion 51 of the diaphragm 50 is under tension, so as to hold the teeth 31 in abutment against the top edge 18 of the outer skirt 15.

The pair of sealing lips 24 bear in leakproof manner against the radially inner surface of the tubular skirt 33 regardless of the up or down movement of the pushbutton 5.

The bulge 58 bears against the central duct 32 via its summit, thereby closing the passage between the pump chamber 34 and the radial openings 36.

At rest, the annular bulge 56 of the flexible lip 53 comes to bear against the inner skirt 20, thereby closing the passage between the pump chamber 34 and the inside of the receptacle.

Figure 7:
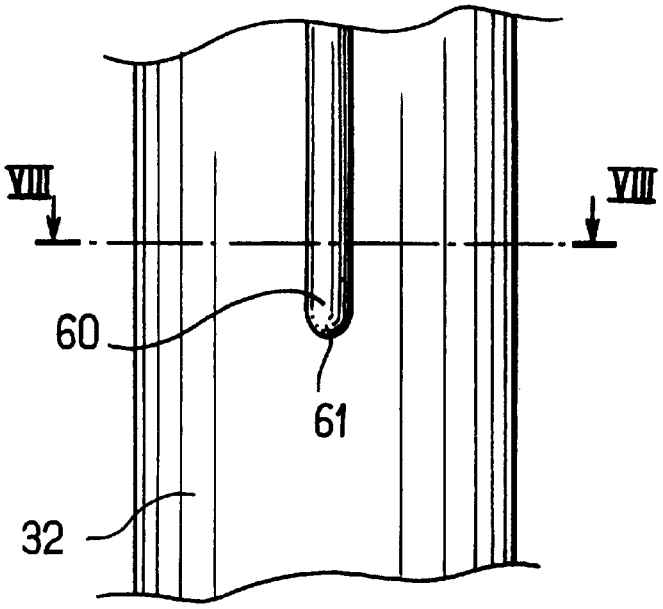
FIG. 7 is a fragmentary and diagrammatic view of the central duct.
Figure 8:
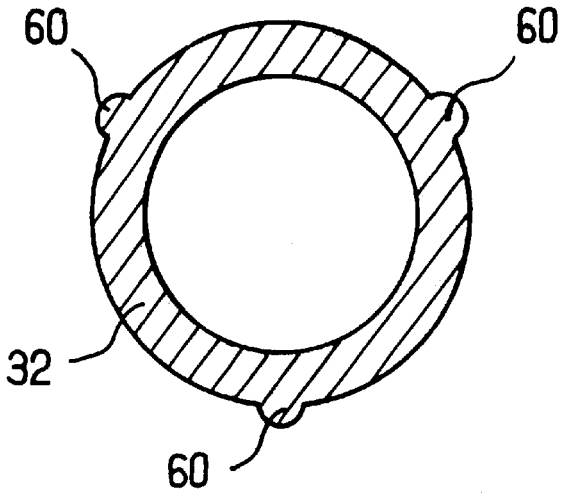
FIG. 8 is a cross-section on section line VIII–XIII of FIG. 7.

As shown in FIGS. 7 and 8, the central duct 32 advantageously includes ribs 60 that are parallel to the axis X, the bottom ends 61 of said ribs moving away from the annular bulge 58, when the pushbutton is in the high position, by a distance corresponding to the down stroke of the pushbutton.

The ribs 60 are optional, but facilitate priming of the pump as explained above.

Figure 11:
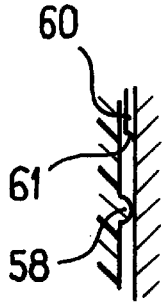
FIGS. 11 and 12 show the action of a portion in relief of the central duct on the bulges of the diaphragm.

Before the pushbutton reaches its low position, the bottom ends 61 of the ribs 60 are situated above the annular bulge 58, as shown in FIG. 11.

When the pump is not primed, there is air in the pump chamber 34 which should be eliminated.

Figure 12:
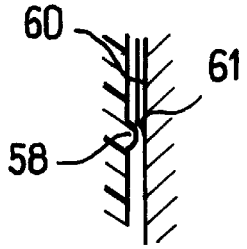

The ribs come into contact with the annular bulge 58 at the end of the down stroke of the pushbutton so as to ensure that the annular bulge 58 moves well away from the central duct 58, as shown in FIG. 12.

The risk of the air pressure in the pump chamber being insufficient to cause a passage to be created between the pump chamber 34 and the radial openings 36 is thus prevented.

The support 4, the pushbutton 5, and the diaphragm 50 constitute a pump which operates as follows.

Figure 9:
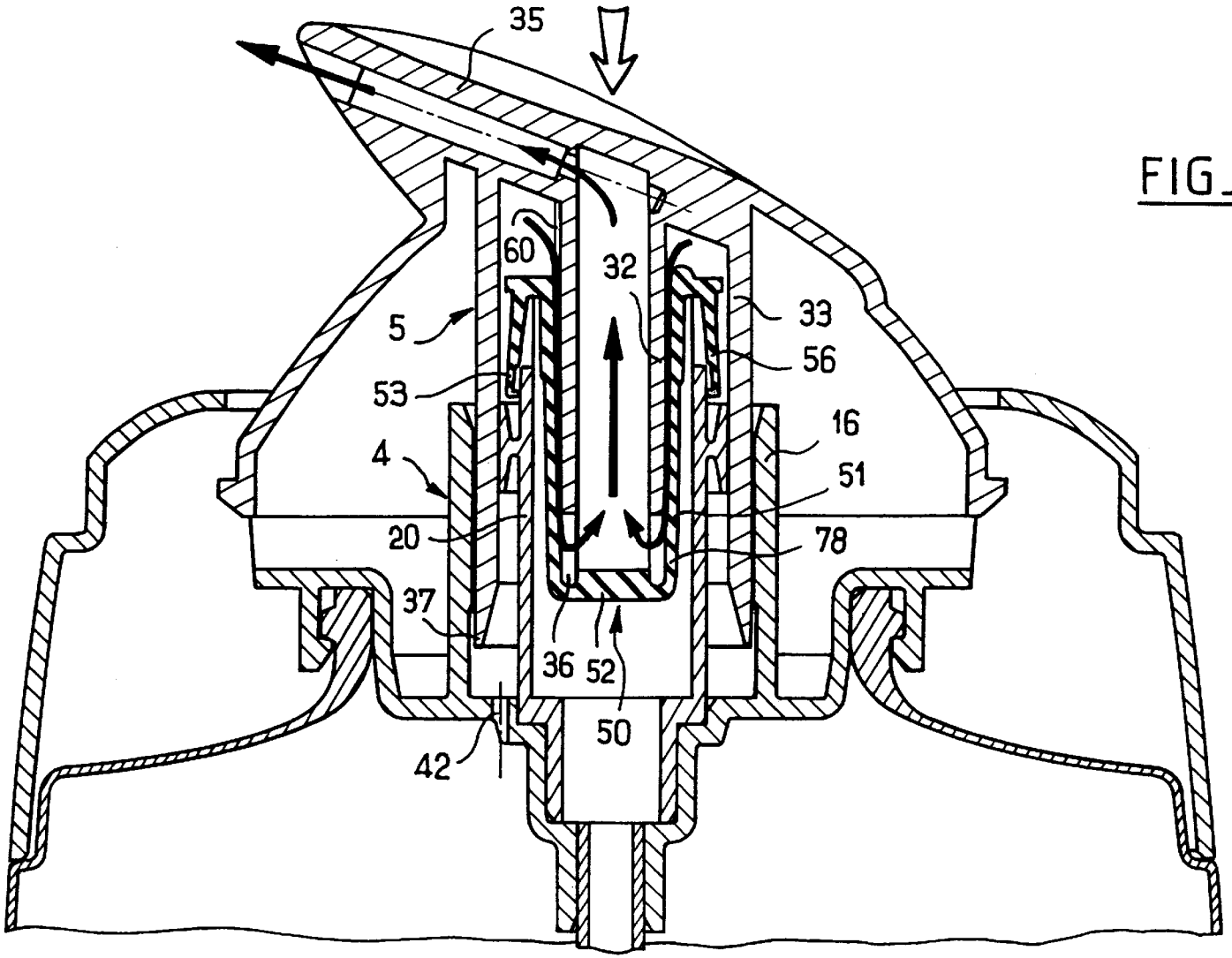
FIG. 9 shows how the pump operates when the pushbutton is depressed.

When the user presses down the pushbutton 5, as shown in FIG. 9, the central duct 32 drives the end wall 52 of the diaphragm 50 downwards, with the diaphragm deforming elastically and stretching so as to accompany the downward movement of the central duct 32.

It is assumed that the pump is primed, i.e. that the pump chamber 34 is full of substance.

During the downward movement of the pushbutton 5, the substance contained in the pump chamber 34 is expelled between the central duct 32 and the central portion 51 of the diaphragm, and it reaches the radial openings 36 of the central duct 32 and then the dispenser endpiece 35.

The inner surface 56 of the flexible lip 53 bears in leakproof manner against the annular bulge 20 during the downward movement of the pushbutton 5.

On reaching the annular setback 41 after the pushbutton 5 has been pushed down a certain distance, the sealing lip 37 of the tubular skirt 33 of the pushbutton 5 ceases to bear in leakproof manner against the guide skirt 16, thereby making communication possible between the inside of the receptacle and the outside via the air intake orifice 42 and the clearance that exists between the guide skirt 16 and the tubular skirt 33.

Between them, the bulges 55 leave passages for the substance and prevent a leakproof annular barrier zone forming between the central duct 32 and the central portion 51 of the diaphragm 50 which might not be overcome by the pressure of the substance, so it is ensured that the substance can reach the radial openings 36, with the annular bulge 58 moving a little away from the central duct 32 under the effect of the pressure in the substance.

The contact surface between the diaphragm 50 and the central duct 32 above the radial openings 36 is relatively limited as a result of the presence of the annular bulge 58, thereby facilitating the creation of a passage towards the radial openings 36.

The bulges 55 tend to hold the central duct 32 coaxially relative to the inner skirt 20 and to guarantee that the diaphragm hooks onto the inner skirt 20.

When the user releases the pushbutton 5, the pushbutton is urged upwards by the central portion 51 of the diaphragm which tends to return to its initial shape.

During the return movement of the pushbutton 5, the annular bulge 58 closes the passage between the radial openings 36 and the pump chamber 34, and the suction which is created in said pump chamber causes the flexible lip 53 of the inner skirt 20 to move away, and draws substance in from the receptacle.

Displacement of the annular bulge 56 is facilitated by the existence of the thin zone 57.

Figure 10:
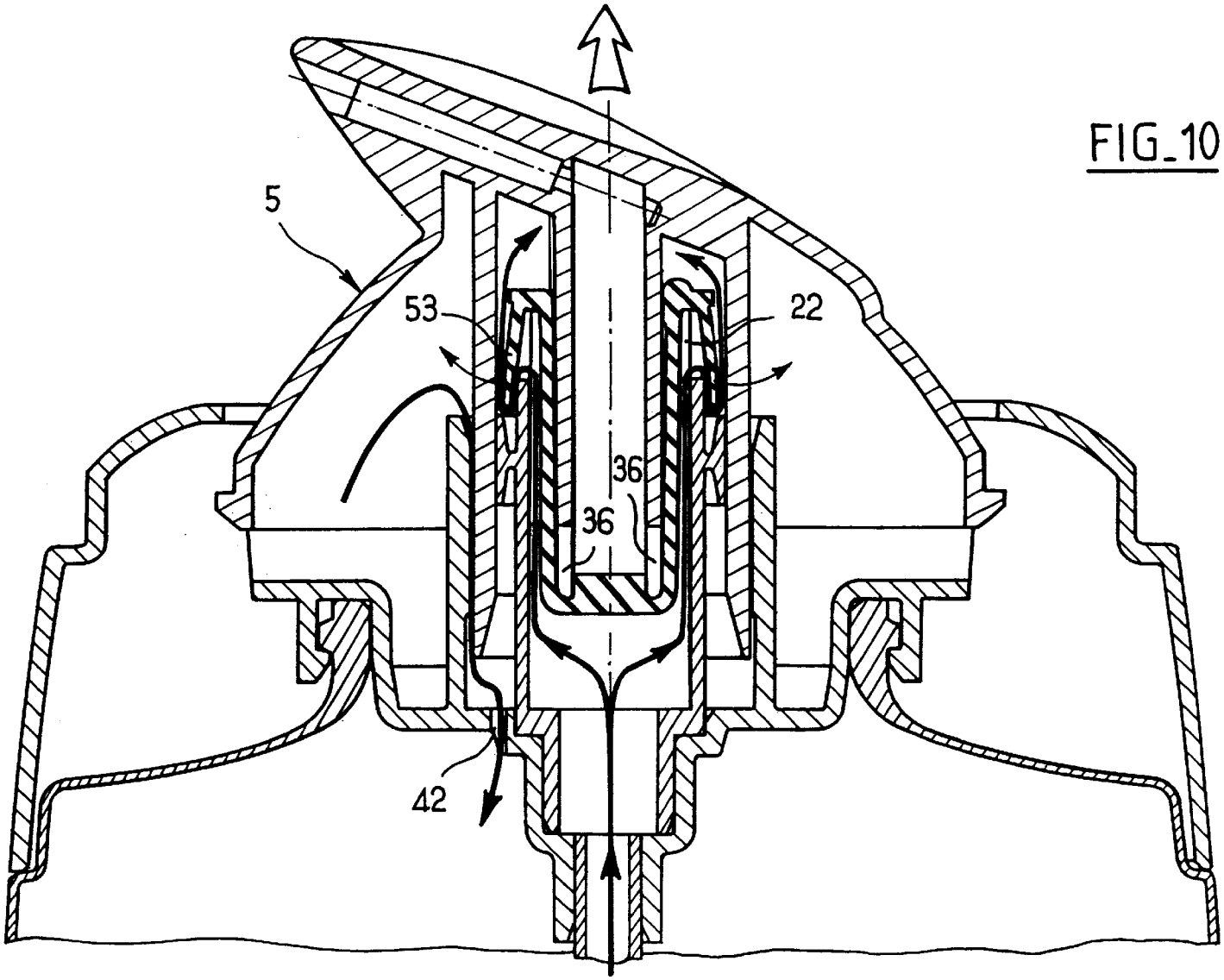
FIG. 10 shows how the pump operates when the pushbutton is released.

The substance reaches the pump chamber 34 by flowing via the grooves 25 of the inner skirt 20 along the central portion 51 of the diaphragm 50, passing through the inner skirt 20 via the openings 22, and then passing round the flexible lip 53 and rising outside it, as shown in FIG. 10.

While the pushbutton 5 is rising, air can penetrate into the receptacle via the clearance that exists between the guide skirt 16 and the tubular skirt 33 and via the air intake orifice 42, and this continues until the sealing lip 37 bears again in leakproof manner against the guide skirt 16 when the pushbutton 5 reaches its high position, as explained above.

Naturally, the invention is not restricted to the embodiment described above.

In particular, the bulges 55 can be replaced by portions in relief formed on the central duct.

The ribs 60 can also be of a size that enables them to fulfill the same function as the bulges 55, thereby enabling said bulges to be eliminated.

Figure 13:
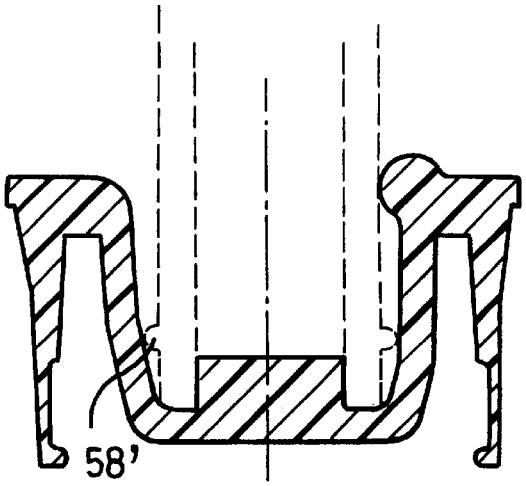
FIG. 13 is a view similar to FIG. 5 showing a variant embodiment of the diaphragm.

The annular bulge 58 can be eliminated and replaced as a variant by an annular bulge 58' formed on the outside surface of the central duct 32 above the radial openings 36, as shown in FIG. 13.

Figure 15:
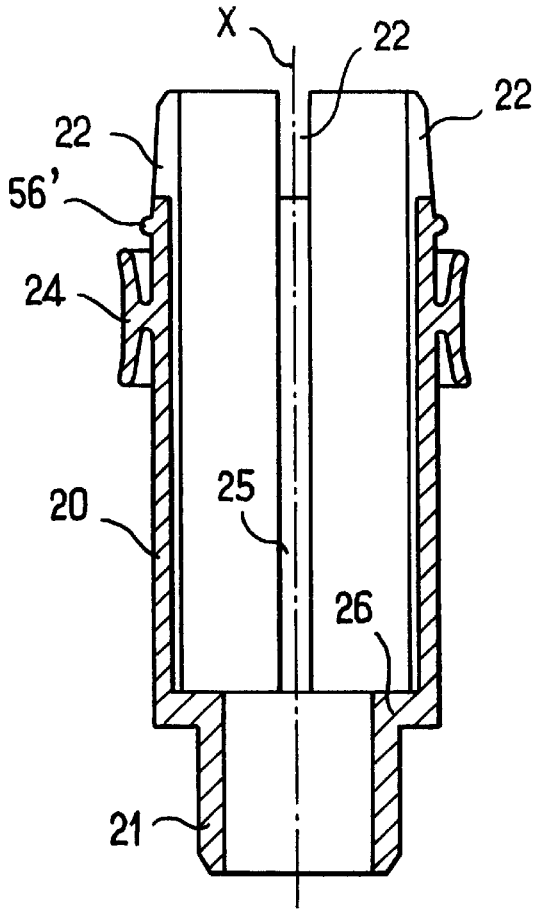
FIG. 15 is a view similar to FIG. 2 showing a variant embodiment of the inner skirt of the support.
Figure 14:
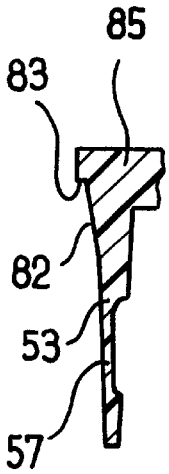
FIG. 14 is a fragmentary view of a variant embodiment of the flexible lip.

In a similar way, the annular bulge 56 can be eliminated as shown in FIG. 14 and replaced by an annular bulge 56' formed on the inner skirt 20 just below the openings 22, as shown in FIG. 15.

What is claimed is:

1. A pump comprising a moving member mounted to move relative to a support, the moving member having a central duct into which the substance to be dispensed penetrates via at least one opening, the support co-operating with the moving member to define a variable volume pump chamber around said central duct, the pump also having a diaphragm having a central portion in which said central duct is inserted, the diaphragm being organized in such a manner as to isolate the pump chamber from the opening(s) of the central duct when the volume of the pump chamber increases and the substance is sucked into it, wherein at least one of the central duct and the central portion of the diaphragm includes an annular bulge that is suitable, when the volume of the pump chamber increases, for bearing in leakproof manner on the other of the central portion and the central duct of the diaphragm, so as to isolate the pump chamber from the opening(s) of the central duct.

2. A pump according to claim 1, wherein the central portion of the diaphragm includes an annular bulge that, at rest and when the volume of the pump chamber increases, bears in leakproof manner on the central duct, so as to isolate the pump chamber from the opening(s) of the central duct.

3. A pump according to claim 2, wherein the central duct includes one or more hollow or projecting portions in relief remote from said bulge when the moving member is in the high position, and reaching the bulge at the end of the down stroke of the moving member, the portions in relief being organized in such as manner as to facilitate the creation, at that moment, of a passage between the pump chamber and the opening(s) of the central duct.

4. A pump according to claim 3, wherein the portion(s) in relief is/are in the form of one or more ribs formed on the outer surface of the central duct.

5. A pump according to claim 4, wherein the central portion of the diaphragm includes a base comprising an inner stud that is organized so as to engage in the bottom end of the central duct.

6. A pump according to claim 1, wherein the diaphragm has a flexible lip suitable firstly for isolating the pump chamber from the source of substance when the volume of said pump chamber decreases, and secondly for enabling substance to enter into said pump chamber when the volume thereof increases.

7. A pump according to claim 6, wherein said flexible lip is connected to the central portion of the diaphragm by forming a downwardly open annular trough, and wherein the support includes an inner skirt having its top end bearing against the end wall of said trough to retain the diaphragm when the moving member is moved downwards to decrease the volume of the pump chamber.

8. A pump according to claim 7, wherein one of the flexible lip and the inner skirt includes an annular bulge that is suitable for bearing on the other of the inner skirt and the flexible lip so as to isolate the pump chamber from the inside of the receptacle when the volume of the pump chamber decreases.

9. A pump according to claim 8, wherein the flexible lip includes an annular bulge on its inner surface that is suitable for bearing in sealed manner on the inner skirt so as to isolate the pump chamber from the source of substance both at rest and when the volume of the pump chamber decreases.

10. A pump according to claim 9, wherein the flexible lip includes, above said bulge, a preferred deformation zone that is preferably constituted by a thin zone.

11. A pump according to claim 8, wherein the inner skirt includes on the outer surface an annular bulge that is suitable for bearing in leakproof manner on the flexible lip so as to isolate the pump chamber from the source of substance when the volume of the pump chamber decreases.

12. A pump according to claim 7, wherein the inner skirt is a portion of a piece fitted to the remainder of the support.

13. A pump according to claim 12, wherein the support has a pair of sealing lips bearing in leakproof manner on a tubular skirt of the moving member, said tubular skirt being downwardly open and extending around the central duct concentrically thereabout, said tubular skirt also defining the pump radially outer wall of the pump chamber.

14. A pump according to claim 13, wherein the tubular skirt of the moving member slides inside a guide skirt of the support, co-operating with the inner skirt of the support to define an upwardly open annular trough which communicates with the source of substance via at least one air intake orifice, the tubular skirt of the moving member bearing in leakproof manner against said guide skirt when the moving member is at rest and the volume of the pump chamber is at a maximum.

15. A pump according to claim 7, wherein said inner skirt has openings at its top end, the openings being of a height that is less than the height of the flexible lip, said openings enabling the substance to reach the pump chamber when the volume thereof increases and the flexible lip moves away from the inner skirt under the effect of thrust from the substance flowing towards the pump chamber.

16. A pump according to claim 7, wherein the height of the flexible lip is greater than or equal to the height of the central portion of the diaphragm, prior to the diaphragm being assembled in the pump.

17. A pump according to claim 7, wherein the flexible lip is of thickness that increases going towards the top end of the diaphragm.

18. A pump according to claim 7, wherein the inside diameter of the flexible lip is equal to the outside diameter of the inner skirt, ignoring manufacturing tolerances.

19. A pump according to claim 18, wherein the clearance between the flexible lip and the inner skirt is negative or zero.

20. A pump according to claim 1, wherein the central portion of the diaphragm is connected at its top end to an annular portion whose width and thickness are selected in such a manner as to improve retention of the diaphragm when said central portion is stretched.

21. A pump according to claim 20, wherein the thickness of said annular portion, prior to the diaphragm being assembled in the pump, is greater than or equal to the thickness of the diaphragm in its central portion.

22. A pump according to claim 20, wherein said annular portion, prior to the diaphragm being assembled in the pump, is at least 1.5 times wider than it is thick.

23. A pump according to claim 20, wherein said annular portion, prior to the diaphragm being assembled in the pump, is at least twice as wide as it is thick.

24. A pump according to claim 1, wherein, when the moving member is at rest, the length of the central portion of the diaphragm after being assembled in the pump is greater than or equal to 1.5 times its initial length prior to assembly in the pumps or greater than or equal to twice said initial length.

25. A pump according to claim 1, wherein, when the moving member is fully depressed, the length of the central portion of the diaphragm is greater than or equal to twice the initial length of the diaphragm prior to assembly in the pump.

26. A pump according to claim 1, wherein at least one of the diaphragm and the central duct is shaped to prevent an annular zone forming between the diaphragm and the central duct that would prevent the substance contained in the pump chamber from flowing via said central duct when the volume of the pump chamber decreases.

27. A pump according to claim 26, wherein at least one of the diaphragm and the central duct is shaped so as to bear against the other of the central duct and the diaphragm at predetermined locations of its periphery, at least during displacement of the moving member relative to the support.

28. A pump according to claim 28, wherein at least one of the diaphragm and the central duct has portions in relief against which the other of the central duct and the diaphragm comes to bear, at least during displacement of the moving member relative to the support.

29. A pump according to claim 28, wherein said portions in relief are made on the diaphragm.

30. A pump according to claim 28, wherein said portions in relief are made on the diaphragm and comprise bulges uniformly distributed around the axis of the central portion of the diaphragm at its opening, said bulges extending over the top face of the diaphragm.

31. A pump according to claim 1, wherein the central duct of the moving member is provided with at least one radial opening at its bottom end.

32. A pump according to claim 1, wherein the moving member constitutes a pushbutton, the central duct being integrally formed with a dispenser endpiece.

33. A pump according to claim 1, wherein the diaphragm is made of a nitrile elastomer or of a silicone elastomer.

34. A receptacle fitted with a pump as defined in claim 1.

35. A pump according to claim 1, wherein, when the moving member is at rest, the length of the central portion of the diaphragm after being assembled in the pump is greater than or equal to twice its initial length prior to assembly in the pump.

36. A pump according to claim 1, wherein, when the moving member is at rest, the length of the central portion of the diaphragm after being assembled in the pump is greater than or equal to 3 times its initial length prior to assembly in the pump.

37. A pump according to claim 1, wherein, when the moving member is fully depressed, the length of the central portion of the diaphragm is greater than or equal to 3 times the initial length of the diaphragm prior to assembly in the pump.

38. A pump according to claim 1, wherein, when the moving member is fully depressed, the length of the central portion of the diaphragm is greater than or equal to 4 times the initial length of the diaphragm prior to assembly in the pump.

* * * * *